United States Patent [19]

Sato et al.

[11] Patent Number: 5,025,738

[45] Date of Patent: Jun. 25, 1991

[54] NEEDLE THREAD DRAWING DEVICE OF A SEWING MACHINE

[75] Inventors: Shuichi Sato; Shirou Ayusawa, both of Tochigi, Japan

[73] Assignee: SSMC Inc., Edison, N.J.

[21] Appl. No.: 437,230

[22] Filed: Nov. 16, 1989

[30] Foreign Application Priority Data

Dec. 5, 1988 [JP] Japan ..... 63-305952

[51] Int. Cl.[5] ..... D05B 65/00

[52] U.S. Cl. ..... 112/286; 112/253

[58] Field of Search ..... 112/286, 285, 130, 59, 112/122, 253

[56] References Cited

U.S. PATENT DOCUMENTS 834,600 10/1906 Wilson ..... 112/59

4,706,588 11/1987 Fujikawa ..... 112/286

FOREIGN PATENT DOCUMENTS 0222188 12/1984 Japan ..... 112/130

0099060 6/1985 Japan ..... 112/122

1045796 3/1986 Japan ..... 112/285

2095398 9/1990 Japan ..... 112/286

*Primary Examiner*—Werner H. Schroeder

*Assistant Examiner*—Sullivan C. Prak

*Attorney, Agent, or Firm*—Theodore Jay

[57] ABSTRACT

A needle thread drawing device utilizes a thread end holding device rotatably mounted on an arm of a sewing machine. A needle thread gripping puller which can be disposed to be at a thread catch position or a return position has a hook portion at a tip end thereof for catching a needle thread extended downward from a needle hole of a needle. A needle thread drawing member is mounted swingably on the side of the arm and has a hook portion at a tip end thereof. A cam member is positioned at the side of the thread end holding device and is rotatable in synchronism with the puller for rotatably swinging the needle thread drawing member so that the hook portion can hold the needle thread when the needle thread holding portion is positioned over the needle hole of the needle and can draw a thread end of the needle thread when the hook portion of the puller is positioned under the needle hole of the needle when the puller is disposed in the thread catch position.

2 Claims, 7 Drawing Sheets

NEEDLE THREAD DRAWING DEVICE OF A SEWING MACHINE

BACKGROUND OF THE INVENTION

1. Field of the Invention:

The present invention relates to a needle thread drawing device of a sewing machine having a thread end holding unit for applying tension to the needle thread.

2. Description of the Prior Art:

A prior art machine is provided with a thread end holding unit which incorporates a thread cutting device for cutting off a needle thread and a bobbin thread under the processed cloth upon completion of subjecting a piece of processed cloth to a series of stitching operations in the sewing machine. This unit also draws and holds the thread end of the cut off needle thread at the upper side thereof. This thread end holding unit has the function of preventing the thread end of the needle thread from being entangled to form like a bird's nest at the rear side of the processed cloth at the time of starting the stitching operation for the succeeding processed cloth.

Another prior art thread end holding unit is disclosed in Japanese Utility Model Publication No. 61-8863. This thread end holding unit comprises a needle thread gripping puller provided at the side of an arm of the sewing machine. This puller is driven to take a catch position or a return position and has a hook portion for passing the needle thread extending downward from the needle toward the processed cloth, at the time of forward movement, to take the catch position and for catching the needle thread at the time of taking the return position. Two holding members are secured to the side of the arm of the sewing machine for accommodating telescopically the needle thread gripping puller and for pressing and holding the needle thread contacting the needle thread gripping puller at the tip end thereof when caught by the hook portion at the time when the needle thread gripping puller takes the return position.

However, in the prior art thread end holding unit, inasmuch as the needle thread can be caught by the hook portion of the needle thread gripping puller, and the needle thread gripping puller pushes the needle thread extending perpendicularly from the needle toward the processed cloth to take its ultimate position at the time when the needle thread gripping puller takes the forward movement so as to be positioned in the catch position, a loose portion of the flexible needle thread would be formed. As a result, when the needle gripping puller is moved from the thread catch position to the return position, a condition can occur wherein the hook portion of the needle thread passing the same route as the forward movement does not catch the needle thread. At this time, the thread end holding unit does not perform properly and the quality of the processed cloth deteriorates.

SUMMARY OF THE INVENTION

The present invention has been made to overcome the drawbacks of the prior art thread end holding unit.

It is therefore a first object of the present invention to provide a needle thread drawing device of a sewing machine which will improve the reliability of the thread end holding device.

A second object of the present invention is to provide a needle thread drawing device of a sewing machine capable of eliminating in a timely and easy manner a loose portion of the needle thread.

A third object of the present invention is to provide a needle thread drawing device of a sewing machine which can be easily utilized in prior art sewing machines by mere addition of a cam member and a needle thread drawing member.

To achieve the above objects, the needle thread drawing device of a sewing machine employs an arm of a sewing machine. A needle is mounted on the arm so as to move vertically. The needle has a needle hole through which a needle thread is threaded. A thread end holding device is rotatably mounted on the arm and has a needle thread gripping puller. The puller can be turned to be positioned at a thread catch position or a return position. The puller has a hook portion at the tip end thereof for catching the needle thread extended downward from the needle hole of the needle when the puller is disposed at the thread catch position. The needle thread is kept caught and held by the hook portion when the puller is disposed at the return position. The needle thread drawing device further comprises a needle thread drawing member mounted swingably on the side of the arm and having a needle thread holding portion at the tip end thereof. The device further comprises a cam member positioned at the side of the thread end holding device and rotatable in synchronism with the needle thread gripping puller for rotatably swinging the needle thread drawing member so that the needle thread holding portion can hold the needle thread when the hook portion is positioned over the needle hole of the needle and can draw a thread end of the needle thread when the hook portion is positioned under the needle hole of the needle when the puller is disposed in the thread catch position.

The above and other objects, features and advantages of the present invention will become more apparent from the following description taken in conjunction with the accompanying drawings.

DESCRIPTION OF THE PREFERRED EMBODIMENT

Figure 1:
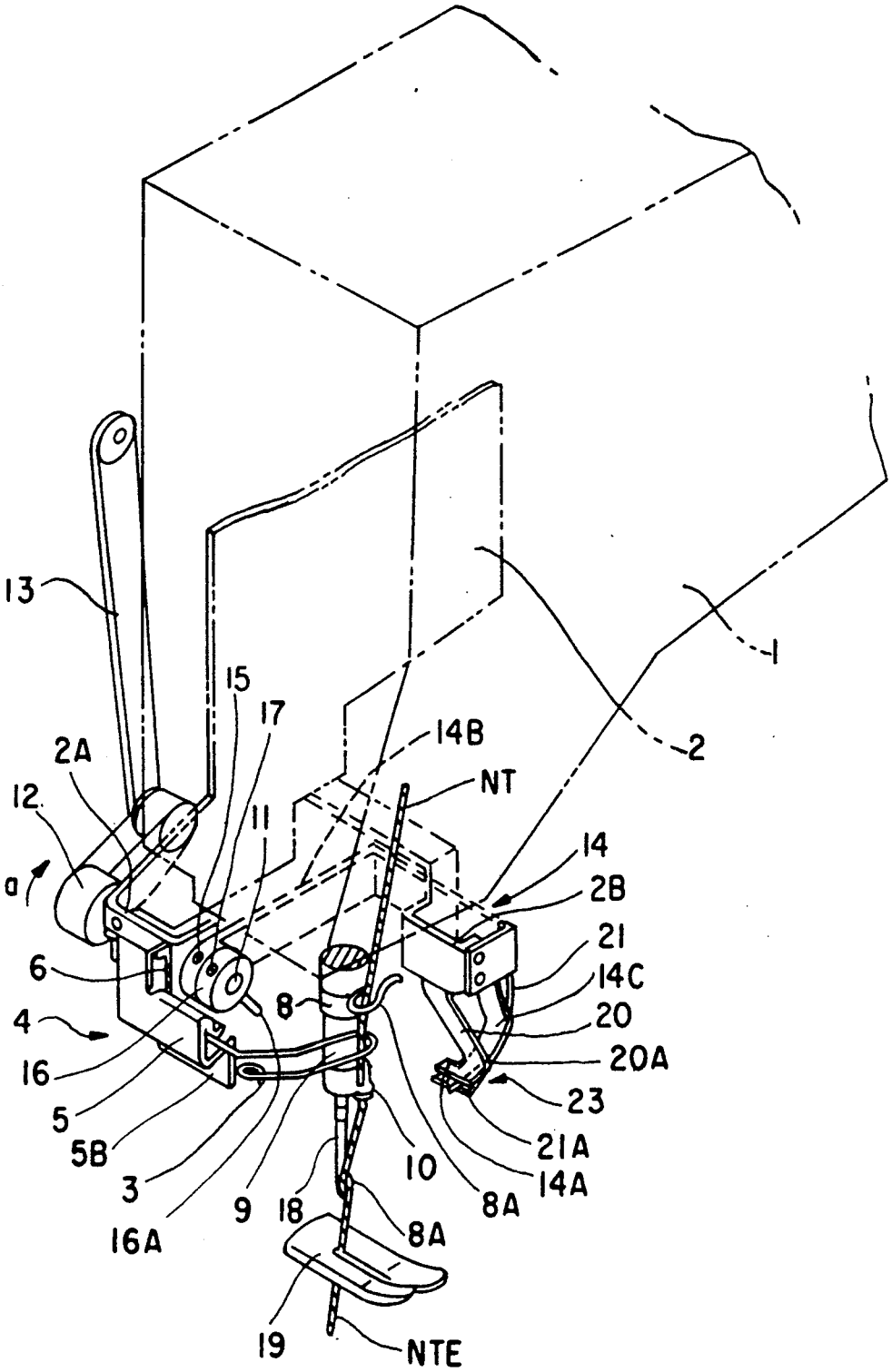
FIG. 1 is a perspective view of a main portion of a needle thread drawing device of a sewing machine provided with a thread end holding device according to a preferred embodiment of the present invention.

A needle thread drawing device of a sewing machine according to a preferred embodiment of the present invention will be described with reference to FIGS. 1 to 7.

The needle thread drawing device of a sewing machine employs an arm 1 of a sewing machine. A needle 18 is mounted on the arm 1 so as to move vertically. The needle has a needle hole 18A through which a needle thread NT is threaded. A thread end holding device 23 is rotatably mounted on the arm 1 and has a needle thread gripping puller 14. Puller 14 is capable of turning so as to be disposed at a thread catch position or a return position. Puller 14 has a hook portion 14A at the tip end thereof for catching the needle thread NT extended downward from the needle hole 18A of the needle 18 when the needle thread gripping puller 14 is positioned at the thread catch position. The needle thread NT is kept caught and held by the hook portion 14A at the return position.

The needle thread drawing device further comprises a needle thread drawing member 3 mounted swingably on the side of the arm 1 and having a hook portion 3A at the tip end thereof. The device also comprises a cam member 26 positioned at the side of the thread end holding device 23 and rotatable in synchronism with puller 14 for rotatably swinging the needle thread drawing member 3 so that the hook portion 3A can hold the needle thread NT when hook portion 3A is positioned over the needle hole 18A of the needle 18 and can draw a thread end of the needle thread NT when the hook portion 14A is positioned under the needle hole 18A of the needle 18 and the puller 14 is positioned in the thread catch position.

Attached to a supporter 2 fixed to a rear surface of chin portion of the arm 1 is driving means (not shown) for driving vertically an operation link 13 upon the reception of the electric signal issued by the control unit (not shown). The operation link 13 has a tip end connected to a tip end of an operation crank 12 by a pin. The operation crank 12 has a base portion fixed to one end of the needle thread gripping puller shaft 11 which is rotatably supported but not movable in the axial direction. A needle thread gripping puller shaft 11 has the other end fixed to puller 14.

The puller 14 has a substantially L-shaped configuration and is composed of an arm 14B fixed by a set screw 15 to the puller shaft 11 at the base end portion thereof and a circular arc portion 14C of circular arc shape about the puller shaft 11 and connected to the tip end of arm 14B. The circular arc portion 14C has hook portion 14A at the tip end thereof for catching the needle thread end NTE of the needle thread NT. The needle 18 is detachably attached to the lower end portion of the needle bar 9 and is vertically movably mounted on the arm 1. The needle 18 forms a stitch on the processed cloth pressed by a cloth presser 19 on the bed (not shown) with use of the needle thread NT threaded into the needle hole 18A and the bobbin thread (not shown). The needle thread NT passes the bobbin, the thread tension unit, the needle thread take-up (respectively not shown), and thereafter passes successively a thread guard 8A of a needle bar bush 8 engaged in the chin portion of the arm 1. A needle bar thread guide 10 is secured to the lower end of a needle bar 9.

The arm hook portion 14A of the puller 14 crosses the vertically reciprocating movement path of the needle 18 at the time when the puller 14 is moved from the return position to the thread catch position so that the hook portion 14A of puller 14 hooks and catches the needle thread end NTE of the needle thread NT which extends along the path and perpendicularly from the needle hole 18A.

As shown in FIG. 1, secured to a bracket 2B extended from the lower end of a supporter 2 is the first holding member 20 and the base end portion of a second holding member 21. The first holding member 20 is formed by a spring member and has a press portion 20A of a circular arc and with a downward convexed shape at the tip end portion bent in L-shape. The first holding member 20 is disposed so that the press portion 20A is positioned over the circular arc portion 14C. The second holding member 21 is a spring member and has a tip portion connected thereto in a L-shaped bent configuration and a flat plate. The tip end edge at the side of the needle thread NT has a downwardly inclined surface forming a press portion 21A for easily receiving the needle thread end NTE. The second holding member 21 is disposed so that the press portion 21A of the second holding member 21 is positioned under the circular arc portion 14C of the needle thread gripping puller 14. The contact position between the lower surface of the circular arc portion 14C of puller 14 and the press portion 21A which presses in wider surface thereof is oppositely directed to the contact position of the press portion 20A of the first holding member 20. The thread end holding device 23 is constituted with this arrangement.

Figure 2:
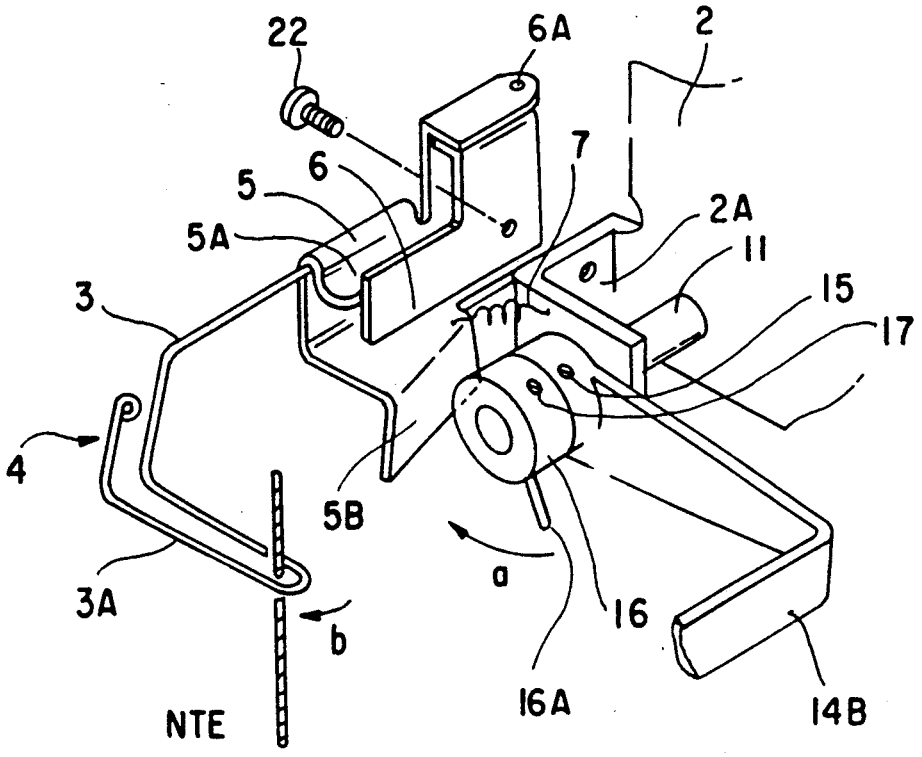
FIG. 2 is a perspective exploded view of the needle thread drawing device of FIG. 1.

Mounted on the arm 1 of the sewing machine is a needle thread drawing device 4. Secured on the side surface of the bracket 2A of the supporter 2 is fixing table 6 secured by a screw 22 as illustrated in FIG. 2. The fixing table 6 has holder 5 which rotates about the axial line extending vertically of a pin 6A. The holder 5 is rotatably urged clockwise in FIG. 2 about the pin 6A by a return spring 7 extended between the holder 5 and the bracket 2A of the supporter 2 whereby a stopper 5A defined by bending the part of the holder 5 is brought into contact with the fixing table 6 to position the tongue portion.

The holder 5 has a thread drawing member 3. The thread drawing member 3 is formed by suitably bending a wire and has a hook portion 3A at the tip end thereof and a base portion pressed into the holder 5. The hook portion 3A of the thread drawing member turns at the front side of the chin portion of the arm 1 and embraces the needle thread NT extending between the thread guard 8A secured to the needle bar bushing 8 and the needle bar thread guide 10 fixed to the needle bar 9. The holder 5 has a tongue portion 5B projecting substantially downward. The tip end portion of the needle thread gripping puller shaft 11 has at the tip portion thereof a shaft wheel member 16 provided with a fixed pin 16A protruding radially. The shaft wheel member 16 is secured to the needle thread gripping puller shaft 11 by set screw 17 thereby constituting a cam member synchronously rotatable together with the needle thread gripping puller 14. The tongue portion 5B of the holder 5 is positioned to engage the fixed pin 16A.

The operation of the needle thread drawing device is described below.

Figure 3:
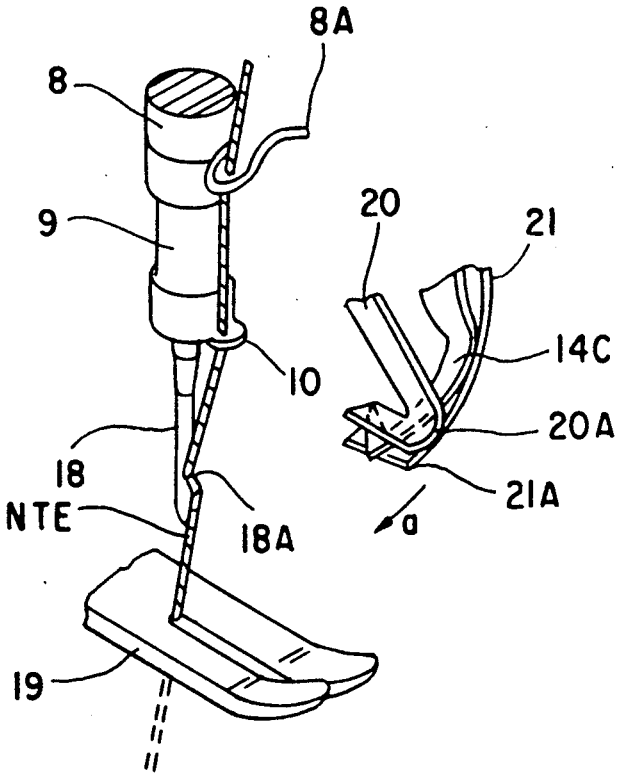
FIGS. 3 to 7 are views illustrating different operations of the needle thread drawing device of FIG. 1.
Figure 4:
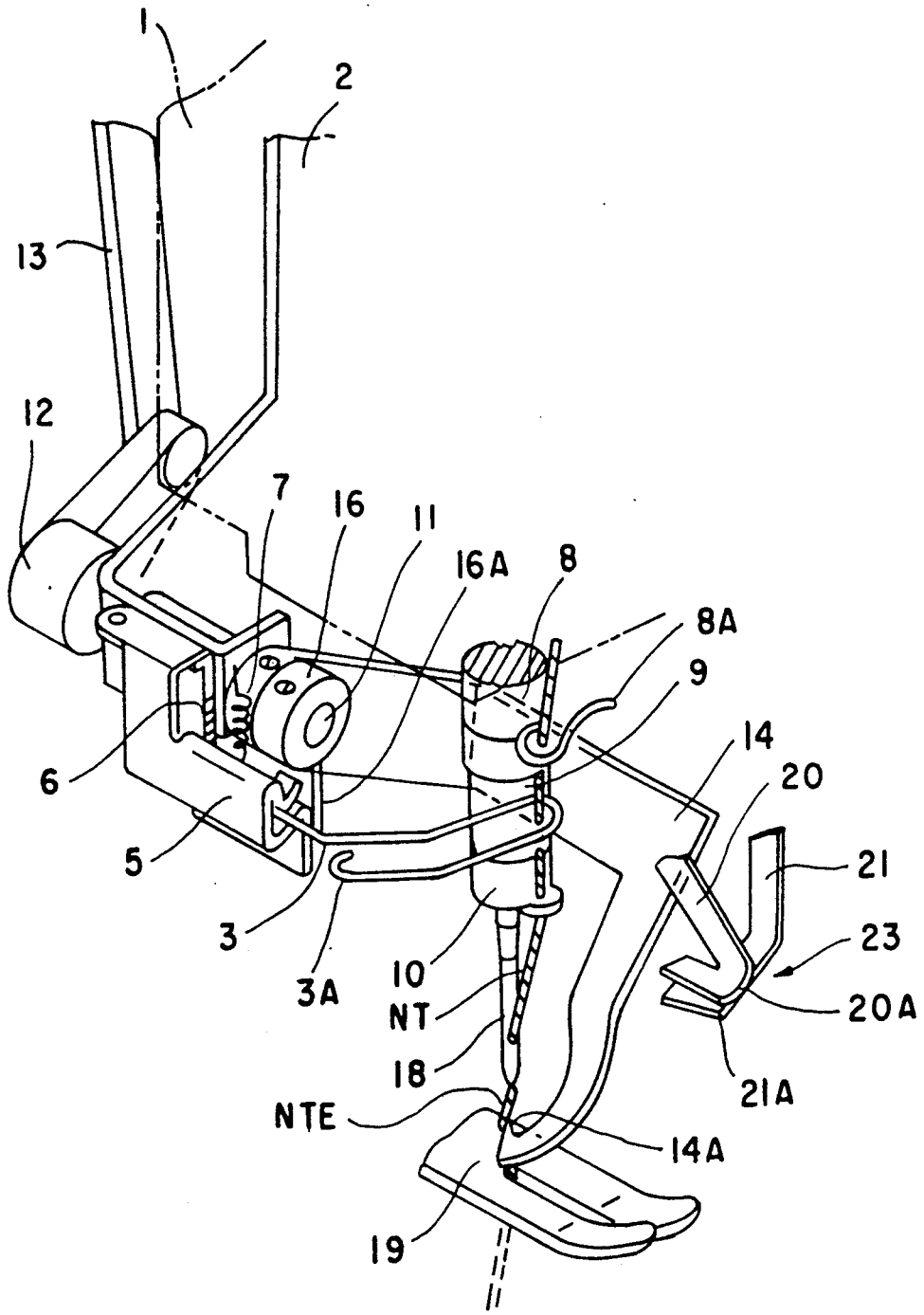
Figure 5:
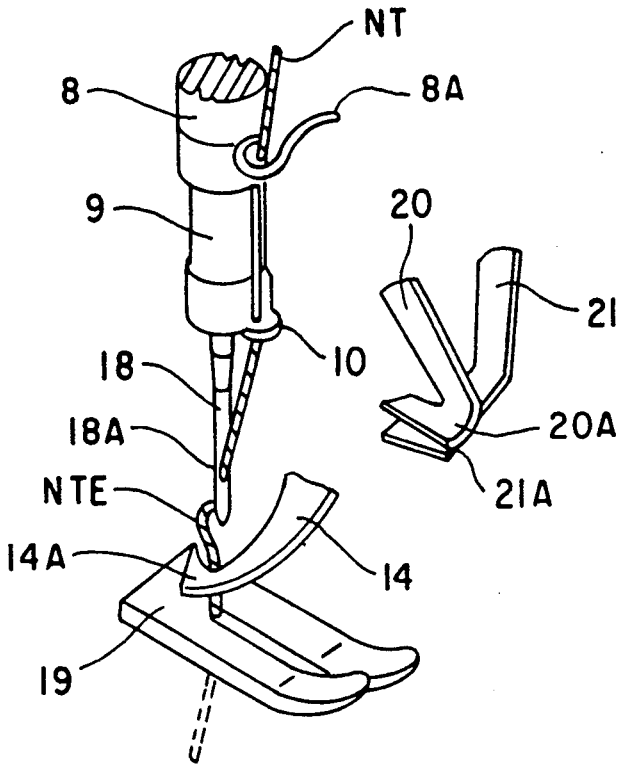

The thread end holding device 23 is in the state as illustrated in FIGS. 1 to 3 just before operation of the thread end holding device 23. That is, upon completion of a series of stitching operations of the processed cloth, the operator depresses the tread pedal of the sewing machine whereby the thread cutting unit (not shown) located under the bed is operated, thereby cutting off the needle thread NT and the bobbin thread under the processed cloth. At this point, the needle 18 is positioned close to the top dead point and the needle thread NT is directed toward the processed cloth (pressed by the cloth presser 19) from the needle hole 18A of the needle 18 and extends perpendicularly along the vertically reciprocating path of movement. The driving mechanism upon reception of the electric signal issued by the control unit is forced to push the operation link 13 down so that the operation crank 12 is rotated in the direction of the arrow a together with the needle thread gripping puller shaft 11. As a result, the needle thread gripping puller 14 integrated with the needle thread gripping puller shaft 11 starts to rotate in the direction of the arrow a starting the forward movement. With the rotation of the needle thread gripping puller 14, the hook portion 14A of puller 14 passes under the needle 18 positioned close to the top dead point as shown in FIG. 4 so that the hook portion 14A of the needle thread gripping puller 14 pushes the needle thread end NTE extending perpendicularly along the vertically reciprocating movement path of the needle 18 to reach the ultimate position and completes the reciprocating movement. Consequently, a loose portion produced on the needle thread end NTE is pushed and retracted by the hook portion 14A as shown in FIG. 5.

Figure 6:
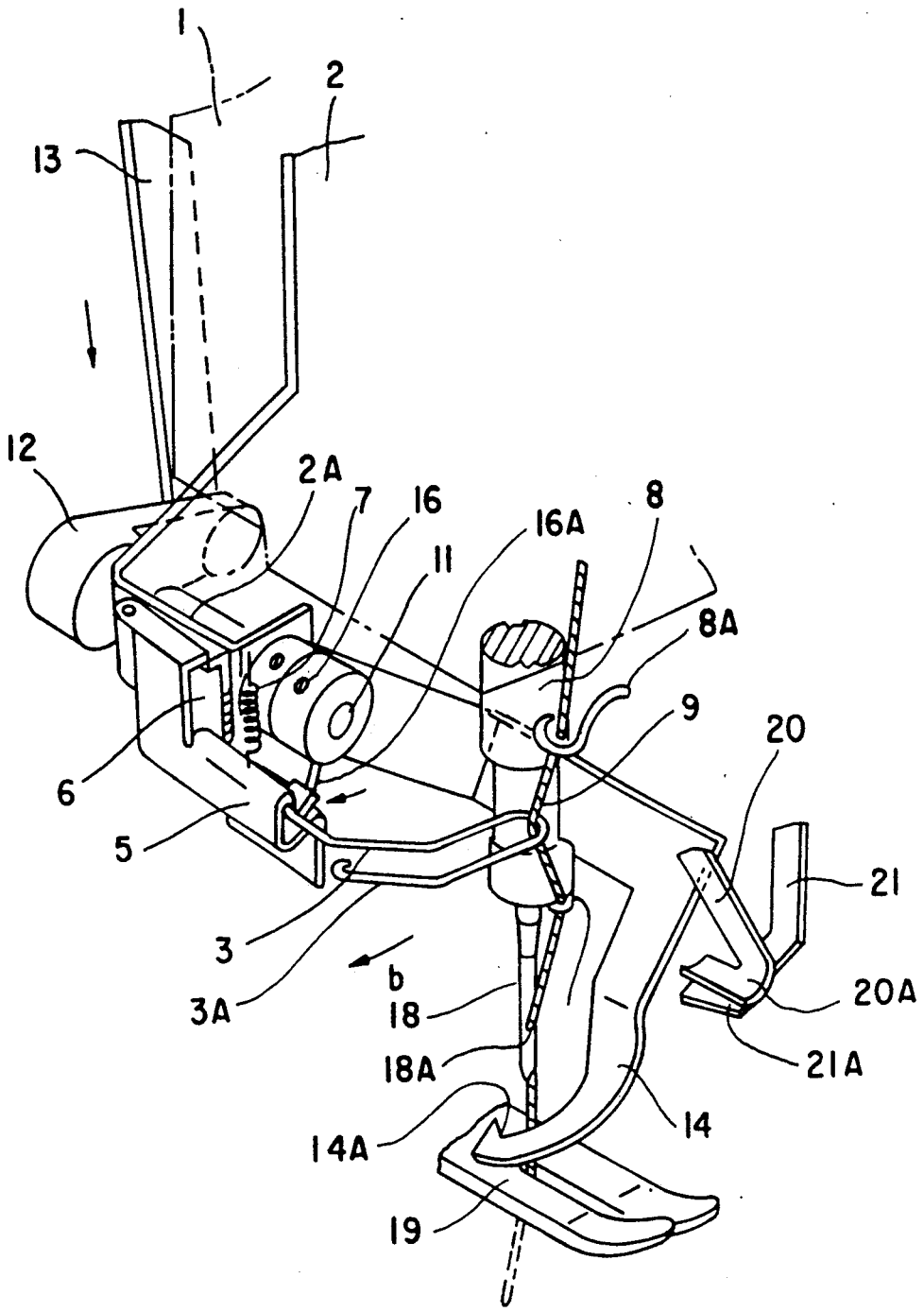
Figure 7:
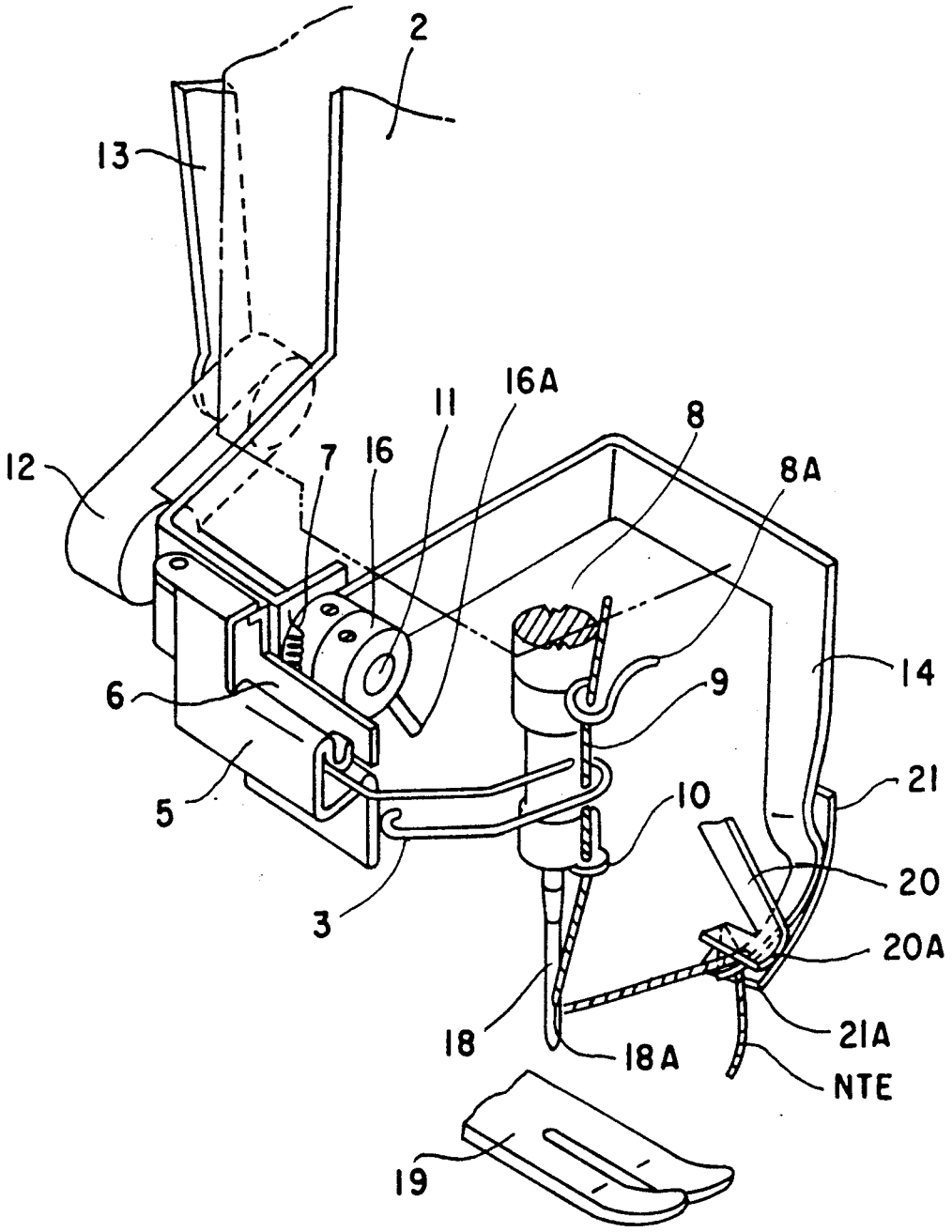

At this point, namely, after the hook portion 14A pushes and retracts the needle thread end NTE and before the hook portion 14A reaches the ultimate position, the fixed pin 16A integrated with the needle thread gripping puller shaft 11 is forced into contact with the tongue portion 5B of the tongue portion 5 rotating the tongue portion 5 about the axial line of the pin 6A. As a result, the thread drawing member 3 integrated with the holder 5 rotates on the substantially horizontal surface in the direction of the arrow b as shown in FIGS. 2 and 6 whereby the needle thread holding portion 3A holds the needle thread NT extended between the thread guard 8A and the needle bar thread guide 10 and draws the needle thread in the direction extending substantially perpendicularly thereto. The needle thread NT restricted by the tension regulating unit at the upper side thereof is drawn at the lower side thereof to remove the loose portion of the needle thread end NTE.

Figure 9:
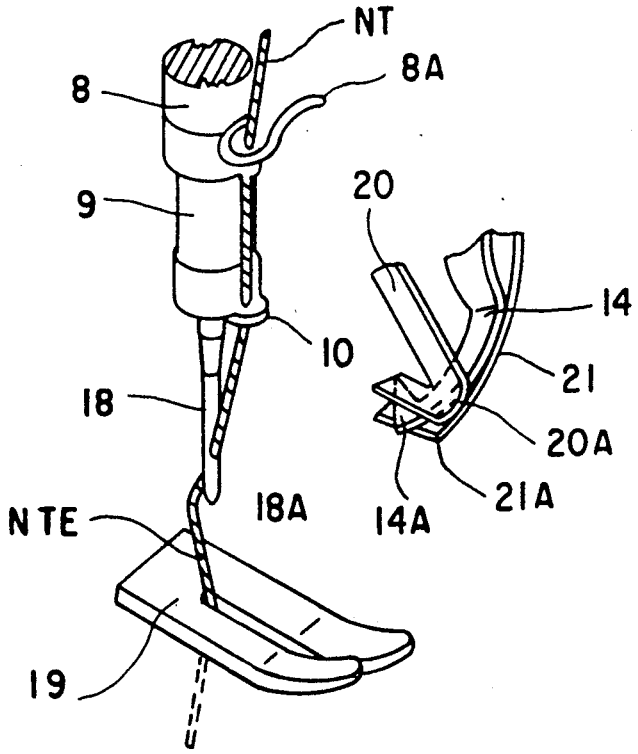
FIG. 9 is a view illustrating operation of a sewing machine without needle thread drawing device.

In the succeeding step, when the driving unit is moved backward to raise the operation link 13, puller 14 starts to return via the operation crank 12 and the needle thread gripping puller shaft 11 to start the backward movement. The return movement of puller 14 is effected at the time when the loose portion of needle thread end NTE of the needle thread NT has been removed and extended perpendicularly from the needle 18 and is surely held by the hook portion 14A whereby the hook portion 14A is returned so as to enter between the press portion 20A of the first holding member 20 and the press portion 21A of the second holding member 21. With such an operation, at the time when puller 14 takes the return position, the presser portion 20A and the presser portion 21A are elastically pressed into contact with each other. The needle thread held and caught by the needle thread NT is bent at the hook portion 14A and both sides of the needle thread end NTE are held by the presser portion 20A and the presser portion 21A. Accompanied by the return of puller 14, the fixed pin 16A returns and the holder 5 returns by the elastic force of the return spring 7 so that the stopper 5A returns to its original position to be brought into contact with the fixing table 6 as shown in FIG. 2. If the loose portion is retained on the needle thread end NTE in the backward movement of the needle thread gripping puller 14 as shown in FIG. 9, it is possible that the hook portion 14A will not catch the needle thread end NTE. However, the hook portion 3A of the thread drawing member 3 according to the embodiment of the present invention is disposed to hold the needle thread NT extending between the thread guard 8A and the needle bar thread guide 10, hook portion 3A may be disposed to hold the needle thread NT extending upward from the needle hole 18A and driven to cross the extension direction of the needle thread NT, since hook portion 3A removes the loose portion of the needle thread end NTE extending downward from the needle hole 18A.

SECOND EMBODIMENT (FIG. 8)

Figure 8:
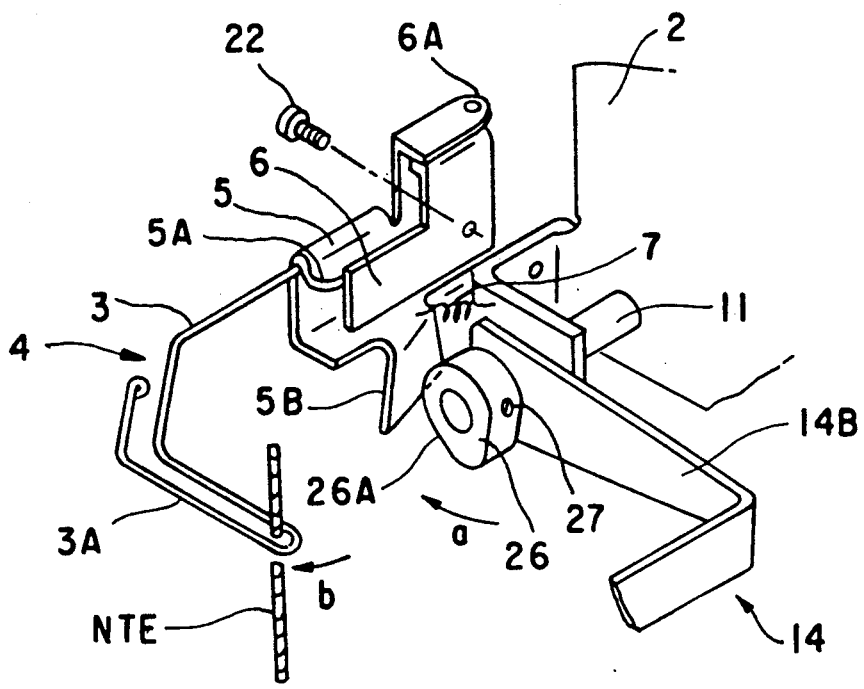
FIG. 8 is a perspective exploded view of another embodiment of the present invention.

The arrangement as illustrated in FIG. 8 shows an example of a cam member 26 fixed to the needle thread gripping puller shaft 11 (instead of the fixed pin 16A of the shaft wheel 16) in which the cam member 26 is detachably attached to puller shaft 11 by a set screw 27. According to this arrangement, the tongue portion 5B of the holder 5 can be swingably driven in synchronism with the thread end holding device 23 by a cam surface 26A of the cam 26 to thereby obtain the same advantage as that mentioned in the first embodiment.

With the arrangement of the needle thread drawing device of the sewing machine according to a preferred embodiment of the present invention, the following advantages can be achieved.

(1) Inasmuch as the thread end of the needle thread extends substantially perpendicularly after removal of the loose portion thereof at the time when the thread end is caught by the hook of the needle thread gripping puller, there is no likelihood of miscatch, thus improving the reliability of the thread end holding device. As a result, a bird's nest will not be generated at the time cloth is processed thereby improving the quality of the processed cloth.

(2) Inasmuch as the operation of the cam member can be correctly synchronized with the operation of the needle thread gripping puller, the loose portion of the needle thread can be timely removed.

(3) As compared with the sewing machine provided with the prior art thread end holding device, the advantages set forth above can be achieved easily with the arrangement of adding a cam member and a needle thread drawing member to the prior art arrangement. As a result, the arrangement of the present invention can be applied with ease to the prior art sewing machine.

Although the invention has been described in its preferred form, it is to be understood that many variations and changes are possible in the invention without departing from the scope thereof.

What is claimed is:

1. A needle thread drawing device for a sewing machine having an arm and comprising:

a needle mounted on the arm so as to move vertically, the needle having a needle hole through which a needle thread is threaded;

a thread end holding unit rotatably mounted on the arm, said unit having a needle thread gripping puller, the puller having a tip end with a hook portion thereat, said puller when turned is positioned either at a thread catch position or a return position, the hook portion catching the needle thread extended downward from the needle hole of the needle when the puller is positioned at the thread catch position, the needle thread is caught and held by the hook portion when the puller is positioned at the return position;

a needle thread drawing member mounted swingably on the side of the arm and having a tip end with another hook portion thereat; and a cam member disposed at the side of the unit and rotatable in synchronism with the puller for rotatably swinging the needle thread drawing member so that said another hook can hold the needle thread when said another hook is positioned over the needle hole of the needle and can draw a thread end of the needle thread when said hook of the puller is positioned under the needle hole of the needle and when the puller is positioned in the thread catch position.

2. A needle thread drawing device according to claim 1, wherein the needle thread gripping puller has a shaft, said cam member being detachably attached to said shaft by a set screw.

* * * * *